US005467985A

United States Patent [19]

Jones

[11] Patent Number: 5,467,985

[45] Date of Patent: Nov. 21, 1995

[54] OBJECTIONAL AIR SKELLY GAME

[76] Inventor: Darryl L. Jones, 1569 Bruckner Blvd. #14B, Bronx, N.Y. 10472

[21] Appl. No.: 305,840

[22] Filed: Sep. 14, 1994

[51] Int. Cl.[6] ..... A63F 7/07

[52] U.S. Cl. ..... 273/126 R; 273/128 R; 446/179

[58] Field of Search ..... 273/126 R, 126 A, 273/127, 128 R, 128 CS; 446/179

[56] References Cited

U.S. PATENT DOCUMENTS

| | | | |
|---|---|---|---|
| 3,488,882 | 1/1970 | Scott | 446/179 |
| 3,722,888 | 3/1973 | Ducharme | 273/126 R |
| 3,773,325 | 11/1973 | Crossman et al. | 273/126 A |
| 3,871,585 | 3/1975 | Crossman et al. | 273/126 A X |
| 3,887,187 | 6/1975 | Crossman et al. | 273/126 A |
| 3,927,884 | 12/1975 | Glass et al. | 273/127 R X |
| 3,927,885 | 12/1975 | Crossman et al. | 273/126 R |
| 3,931,974 | 1/1976 | Goldfarb et al. | 273/126 R |
| 3,992,009 | 11/1976 | Trbovich | 273/126 R |
| 4,968,036 | 11/1990 | Von Der Mark | 273/128 R |

*Primary Examiner*—William H. Grieb
*Attorney, Agent, or Firm*—Michael Marinangeli

[57] ABSTRACT

The present invention relates to a new board game in which the players shoot tops, Skelly Tops, around an air cushioned board having number 1–13. The players in this Objectional Air Skelly board game use their preferred top and try to eliminate their opponents game position while covering all 13 numbers, in sequence, and then retracing the numbers from 13 to 1 themselves, thereby becoming winners. This novel game can be played indoors or outdoors and can be played by anyone, from child to adult. Every play of this game is different and offers contestants a variety of challenges while increasing their own game skill.

5 Claims, 2 Drawing Sheets

OBJECTIONAL AIR SKELLY GAME

FIELD AND BACKGROUND OF THE INVENTION

The present invention generally relates to a game device. More particularly, the present disclosure is to a new board game in which the players shoot their Objectional Skelly top around a board having number 1–13, seeking to eliminate their opponent's Objectional Skelly tops while covering all 13 numbers then returning to 1, in sequence, thereby becoming winners. This novel game can be played indoors or outdoors and can be played by anyone, from child to adult. There are presently generally known various games but none offer the same challenge, action and excitement as offered by the board game disclosed herein.

DESCRIPTION OF THE PRIOR ART AND OBJECTS OF THE PRESENT INVENTION

The present invention relates generally to air cushion board game having a new method of play, and more particularly to a game wherein players shoot their Objectional Skelly tops in a way to cover numbers from 1 to 13 and then back down to 1 again.

Generally air cushion table games are well known. These air cushion games are typically for known games such as hockey, bowling or shuffleboard. These air cushion games generally include an air bed or perforated surface to which air under pressure is supplied from below, creating a multiplicity of closely spaced air jets upon which a game top floats without touching the table surface. The table is usually bounded by a sturdy bumper rail, which imparts a solid rebound to the top whereas in the present game the tops can go on and off the board. Each player is usually provided with a top moving device, which he slides across the table surface and into contact with the top whereas in the present game the tops are simply moved by the players fingers. An automatic scoring system is optionally provided to receive and record the passage of tops not blocked by the defending player. See, for example, U.S. Pat. Nos. 3,773,325; 3,871,585; 3,887,187; and 3,927,885 relating to air hockey games; and U.S. Pat. No. 3,927,884, relating to another type of air cushion table game. However, none of these generally known air cushion table games have the same game methology as disclosed herein and which is called the "Objectional Air Skelly" game.

OBJECTS OF THE INVENTION

A principal object of this invention is to provide an air cushion board game that is enjoyable for both children and adults to play.

Another object of the invention is to provide an air cushion board game which is easy to learn and master while providing different challenges with every play.

A still further object of the invention is to provide an air cushion board game which is of a unitary one-piece integral construction.

An additional object of the invention is to provide an air cushion board game in which the ramp edges of the entire board are razor thin flush with the floor so that the player's Objectional Skelly top can easily enter and exit from the board during the game.

Another object of the invention is to provide an air cushion board game that does not require a top moving device because the game tops herein can be simply moved by the players fingers.

A still further object of the invention is to provide an air cushion board game in which both the board and the tops are provided with fans to create both an upward and downward air flow so the player's Objectional Skelly top can glide easily across the entire board.

It has now been found that the above and related objects of the present invention are obtained in an air cushion table game of novel construction. In its conventional aspects, the game comprises, in combination, an air bed having an upper surface defining a playing surface, and means for creating an air cushion above the playing surface. The fame additionally includes a game piece or Objectional Air Skelly top having an area and weight such that it floats upon the air cushion during play and is capable moving over the playing surface generally without touching it, and means for engaging the game piece so as to cause it to move upon the air cushion and over the playing surface. In another preferred embodiment the top can have its own battery powered fan therein for creating a downward flow of air.

In the novel aspects of the game, the air bed comprises top and bottom players. The top layer, having a multiplicity of apertures, has thereunder a multiplicity of air fans exhausting air upwardly there-through and arranged in a substantially uniform pattern over the playing surface of the top layer to form the air cushion. The bottom layer is of the same material as the top layer, and is disposed below and connected to the top layer. The top and bottom layers are connected together by a ramp with ends razor flush with the adjacent ground surface. Within the opening between the top and bottom boards and connecting side ramps are a plurality of battery powered air fans. These fans will force air through the plurality of openings thereby creating an air cushion for the game tops.

The game pieces or Skelly Tops have varying features depending on the skill and strategy of each individual player.

Other objects and features of the invention will become apparent to those skilled in the art as the following detailed description of the preferred embodiment of the invention as illustrated in the accompanying sheets of drawing.

BRIEF DESCRIPTION OF THE DRAWINGS

The present invention will now be described in detail with reference to the accompanying drawings, in which.

DETAILED DESCRIPTION OF THE GAME APPARATUS AND METHOD OF USE

Figure 1:
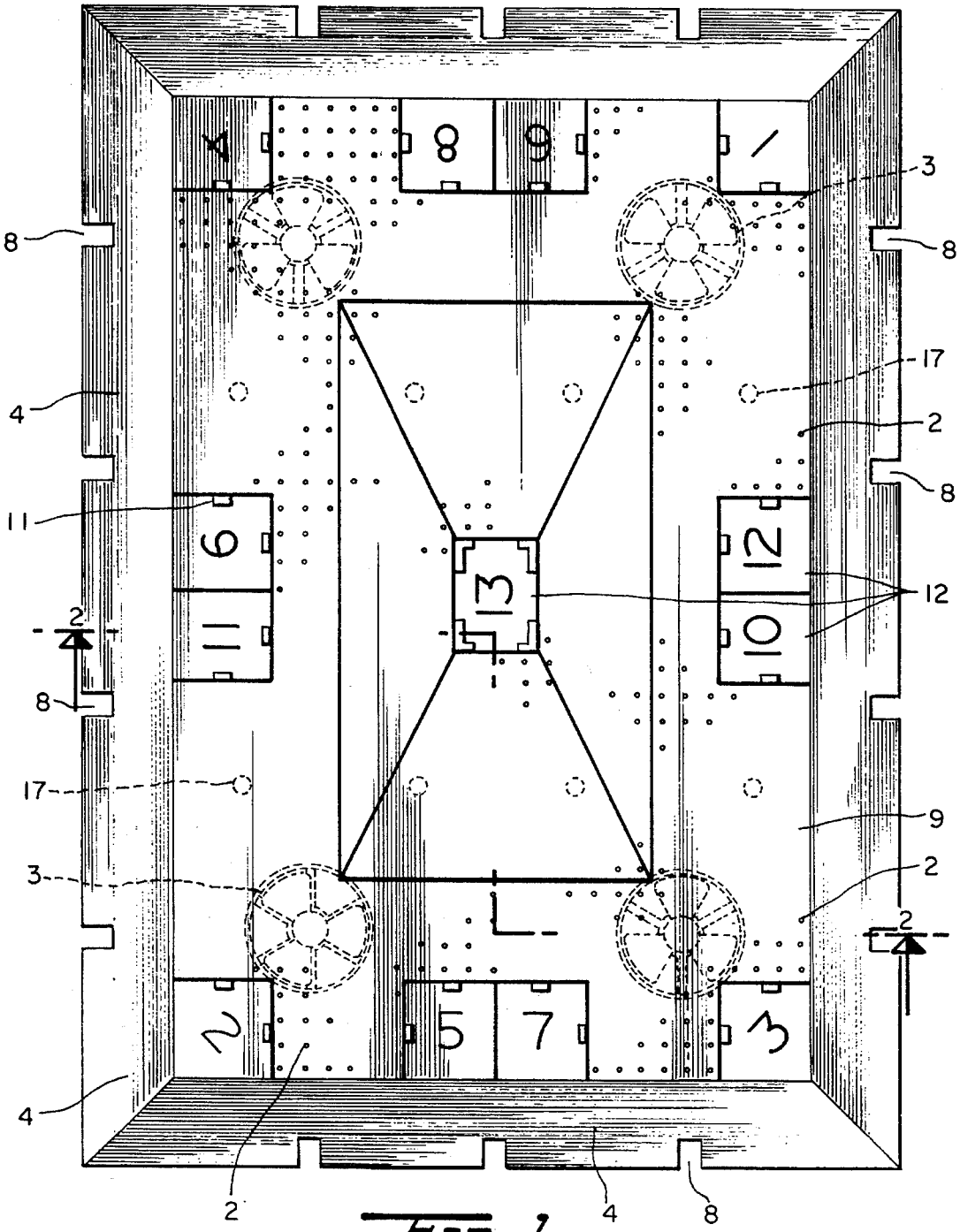
FIG. 1 is a top perspective view of the game board having a plurality of openings thereon thru which an air cushion is created by air fans arranged under the game board.
Figure 2:
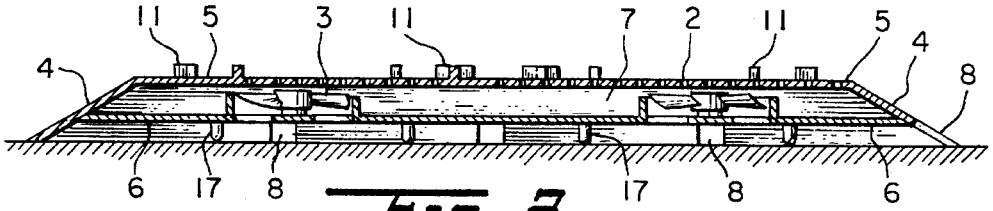
FIG. 2 is a sectional view taken thru line 2—2 of FIG. 1 of the game board showing its side ramps being razor flush with the adjacent ground surface on which the game board is placed so the game tops can be easily shot onto the board surface from the adjacent ground surface.

Referring now to the drawings and more particularly to FIGS. 1 and 2 in which are shown top and side perspective views of a game board 1 having a top layer 5 and a bottom layer 6 of material. The top layer 5, having the numbered playing surface thereon, is of the same material as and is disposed above and connected to the bottom layer 6 by way of a side ramp 4. The side ramp 4 is of a length and dimension to be razor flush with the adjacent ground surface and to provide support for an opening 7 between the top and bottom layers which houses air cushion means and power means. A plurality of legs 17 support the bottom layer 6 above the adjacent ground so as to al low air to enter ducts 8 which are described below. The top layer 5, the bottom layer 6 and side ramp 4 preferably formed of the same blow-moldable plastic material, preferably of a high density polyethylene, although other plastics such as polypropylene may also be used.

A multiplicity of apertures 2 are evenly arranged throughout the playing surface of the top layer 5 thru which an air cushion of forced air is created by air fans 3. The air fans 3 are arranged between the top layer 5 and the bottom layer 6 of the game board and are powered by generally known means preferably by batteries. The apertures 2 are preferably from 0.030–0.040 inch in diameter and are disposed 0.5 inch apart from one another. Each of the apertures 2 is in gaseous communication with opening 7 so that a buildup in air pressure within the opening 7 relative to the ambient atmosphere causes the air within the opening 7 to exhaust upwardly through the multiplicity of apertures 2.

The bottom layer 6 and ramp 4 have a plurality of ducts 8 which allow for air to enter opening 7. The ducts 8 are preferably 1" in diameter. The fans 3 which are arranged under the top layer 5 and in opening 7, create an air cushion on the playing surface 9 of the top layer 5. The fans 3, which in the preferred embodiment shown are four, are in gaseous communication with ducts 8 so that the air will enter the opening 7, through ducts 8, and then exhaust upwardly, by way of fans 3, through the apertures 2 to form an air cushion above the playing surface 9. The fans 3 are mounted by known means, preferably screws, to the bottom layer 6 in vertical alignment with ducts 8 arranged in the bottom layer 6.

The opening 7 is air tight except for the ducts 8 in the bottom layer 6,ramp 4, and the apertures 2 in the top layer 5. To this end screws (not shown) and similar connectors which pierce the top surface and the ramp are provided with gaskets, sealers or the like (not shown) as necessary to effect the air tight connection. While the dimension of the overall game board may be varied depending on design and production consideration, for a 5'×5' game board, the top and bottom surfaces are 0.3–0.5 inches in thickness and the apertures 2 on the top layer 5 are 0.030–0.040 inch in diameter and spaced 0.5 inches apart over the playing surface 9. The entire game board herein, including the top and bottom layers, 5, 6 and the connecting side ramps 4, which end razor flush with the adjacent ground surface, are made by way of a simple, rapid and economical blow molding operation. The resultant game board is thus of a one-piece integral construction, all made from the same plastic material. As the process of blow molding is a well recognized technique, familiar to those skilled in the art, it is not deemed necessary to provide further details thereof herein, In order to insure that the air forced through the various apertures 2 by the fans 3 is at the same velocity, regardless of the distance of the particular aperture 2 from the ducts 8, the vertical spacing between the bottom surface of the upper layer and the upper surface of the bottom layer may be varied so as to compensate for the loss of air volume reaching the further apertures 2 relative to the nearer apertures 2. To this end, if a duct 8 is disposed in the center of the bottom layer 6, the lower surface of the upper layer or the upper surface of the bottom layer (and, indeed the entire bottom layer) may be concave so that the vertical spacing adjacent the peripheral apertures 2 is less than the vertical spacing adjacent the more central apertures 2, thereby to compensate for the loss of air volume intermediate the central and peripheral apertures 2 and thus maintain a constant air velocity through all of the apertures 2 and thereby a uniform air cushion over the playing surface 9.

Figure 3:
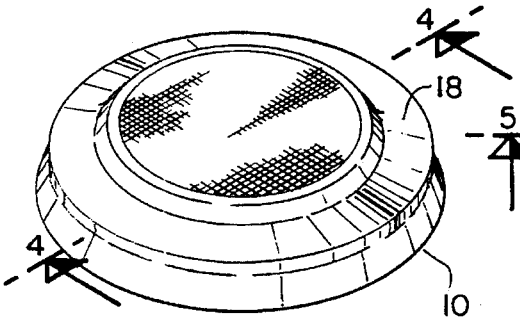
FIG. 3 is a side perspective view of one embodiment of a game top.
Figure 4:
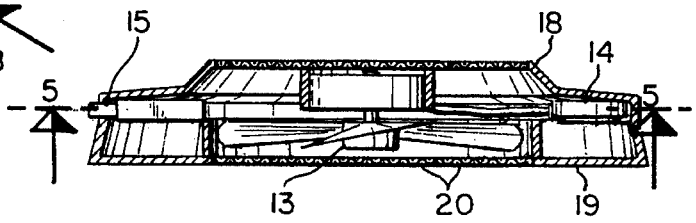
FIG. 4 is a sectional view taken thru line 4—4 of FIG. 3 showing the interior of the top of FIG. 3 wherein a battery powered fan provides additional air cushion when the top is used on the game board.
Figure 6:
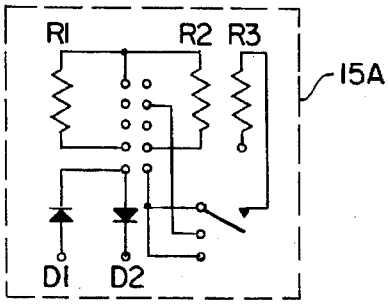
FIG. 6 is a schematic view of the operational chip.
Figure 5:
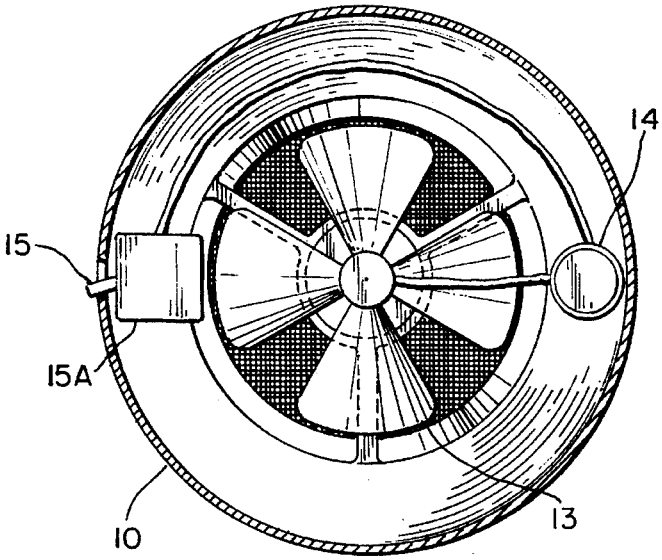
FIG. 5 is a sectional view taken thru line 5—5 of FIG. 4 showing the air fan in the middle flanked and operated by an operational chip and a battery.
Figure 7:
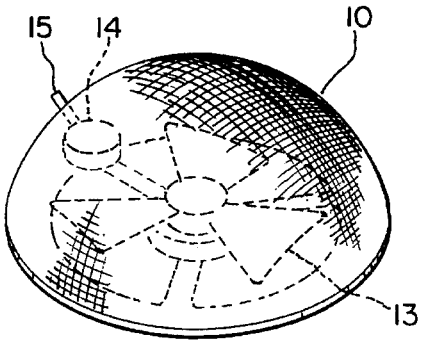
FIG. 7 is a side perspective view of a second embodiment of a game top which like the top of FIG. 3 has an air fan in its center flanked and operated by a a battery.
Figure 9:
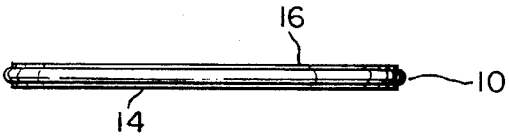
FIG. 9 is a side view of the embodiment of the a game top shown in FIG. 8.
Figure 8:
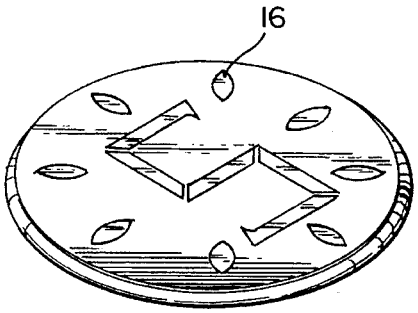
FIG. 8 is a side perspective view of another embodiment of a game top without an air fan therein but instead having a plurality of lights which flash when the top is hit.

Various preferred embodiments of the Skelly top 10 are shown in FIGS. 3–8. A first embodiment of the top is shown in FIGS. 3–5 wherein the top 10 is comprised of a hollow spherical disc having a detachable upper 18 and lower body 19 and a plurality of apertures 20 throughout the lower body. The top 10 is sized to permit the operative arrangement of a battery powered fan 13 therein. As seen in FIG. 5, the top's fan 13 is flanked by a battery 14 and an on/off switch 15 whose schematic diagram **15*a* is displayed in FIG. 6. The Skelly top 10 is generally a circular disc, preferably made of a high-density thermoplastic, e.g., high impact polystyrene. With a diameter of three inches and a thickness of two inches, the weight of the Skelly top will be supported by at least six apertures 2 at all times. Another embodiment of a Skelly top 10 is shown in FIG. 7 where its top has a smooth dome shape. This decreases any air friction when the top 10 is in motion. A third embodiment of the top 10 is shown in FIGS. 8 and 9. This embodiment does not have a fan 13 therein but has lights 16** which are also powered by a battery (not shown) inside the top.

During play of the game, a Skelly top 10 slides virtually friction free across the playing surface 9 of the top layer 5. Contestants (not shown), stand anywhere around the Objectional Air Skelly game board 1 and flick their Skelly tops 10 with their fingers so that it will move up the ramp 4 from the adjacent ground surface and aim for the area or box 12 marked with the numeral 1. The player whose Skelly top 10 is nearest to the 3"×3" area or box marked #1 becomes the first player to shoot. It should be noted that each of numbered box areas #1–12 has two male protrusions or pegs 11 strategically placed on their perimeters so as to make it more difficult and challenging for a player to get his Skelly top 10 onto a numbered box 12. Box #13 has four pegs arranged so that each one is placed in a corner. If a player's Skelly top 10 lands within the 6"×6" box 12 marked #1 he then proceeds to flick his Skelly top 10 so that it will move to box 12 numbered #2. He continues until he fails to reach the next box 12. His opponent then begins and attempts to not only cover boxes #1–13 in sequence but to also hit the other players Skelly top 10 and knock it off the playing board 1. A player can also hit another players Skelly top 10 and move it into a box 12 where it must remain until another players Skelly top knocks it out of said box 12. This challenging game continues until a player can cover all thirteen numbered boxes 12 and then retrace his Skelly top 10 down to the box 12 numbered 1—thereby becoming the winner. The Skelly top 10 moves very fast when moving on this air cushioned table 1 and can move on and off the playing surface by way of the ramp 4. This high speed action by the Skelly top 10 tends to force the contestants alternately into offensive and defensive roles for brief periods of time depending upon who has gained a higher number and better position with his Skelly top 10.

One of the primary features of the present invention is the fact that a sliding game piece or Skelly top 10 will experience minimal frictional drag as it passes over portions including air apertures 2 while encountering a substantially increased frictional drag as it rides over the various imperforate numbered boxes 12. It is to be further appreciated that a player in sliding the Skelly top 10 over the playing surface 9 must allow for frictional drag of the top 10 over air cushioned parts of the playing surface 9 and any imperforate numbered boxes. In addition, a player must utilize various paths of travel for the Skelly top 10, subject to any obstacles or opposing tops 10 therein. In this manner, a player is challenged to anticipate the combined effect of the substantially varying frictional drags so as to place the tops 10 in a desired position. In this manner, a player is challenged to anticipate the combined effect of the substantially varying frictional drags so as to place the tops 10 in a desired position to remain in a winning pattern.

From the foregoing it is apparent that the objects of the present invention have been fully accomplished. As a result of this invention a new type of air cushion game is provided to play a Skelly game which substantially varies from other table games arrangements having a uniform frictional surface for a game top. By means of the present invention, a player's skill and judgment is substantially challenged which results in increased interest and enjoyment during play of the game herein disclosed.

Since the invention is described and illustrated with reference to but a number of preferred embodiments, and since numerous additional modifications and changes may become readily apparent to those skilled in the art after reading this disclosure, it should be understood that I do wish to limit the scope of my invention to the exact construction shown and described above, and as claimed by me below.

What is claimed is:

1. An air cushion board game comprising a top layer and a bottom layer of material, said bottom layer is disposed below and connected to the top layer in an air tight manner by way of an angled side ramp which is flush with the adjacent ground;

a plurality of legs to support the bottom layer above the adjacent ground;

an opening, said opening being the space between the attached top and bottom layers and the side ramp;

a plurality of ducts for receiving air into the opening are arranged in the bottom layer and along the ramp and are in gaseous communication with the outside air;

a playing surface having boxes numbered 1–13 in designated areas is attached to the top layer;

two pegs protrude outwardly from the perimeters of boxes numbered 1–12; and four pegs protrude outwardly from the perimeter of the box numbered 13;

a plurality of apertures; said apertures are evenly arranged throughout the entire playing surface on the top layer, excluding the areas of boxes #1–13;

a multiplicity of air fans; said fans operatively positioned under the top layer in a substantially uniform pattern which blow air thru the apertures in the top layer thereby creating an air cushion on the top layer;

power means; said power means is positioned between the top layer and the bottom layer and is adjacent and attached to the fans so as to operate the air fans;

a game top having an area and weight such that it floats upon the air cushioned playing surface of the top layer when pushed.

2. The air cushion board game of claim 1 wherein the designated areas of the playing surface are 3"×3" areas respectively numbered 1–13 whereby the numbers 1 and 2 are placed in opposing corners of the playing surface of the top layer;

the numbers 3 and 4 are placed in the alternate opposing corners of the playing surface of the top layer;

the numbers 5 and 7 are placed adjacent to one another and placed on the sicks of the playing surface between the corner marked boxes 2 and 3, the numbers 9 and 11 are placed adjacent to one another and placed on the side of the playing surface between the corner marked boxes 2 and 4;

the numbers 8 and 6 are placed adjacent to one another and placed on the side of the playing surface between the corner marked boxes 1 and 4;

the numbers 10 and 12 are placed adjacent to one another and placed on the side of the playing surface between the corner marked boxes 1 and 3;

and number 13 is placed in the middle of the top layer of the game board.

3. The air cushion board game of claim 2 wherein the top and bottom layers and connecting side ramp are plastic and blow molded into a single, unitary, integral construction.

4. The air cushion board game of claim 3 where there are four fans and four ducts in the bottom layer and in vertical alignment with the four fans.

5. The air cushion board game of claim 4 wherein the power means are batteries.

* * * * *